United States Patent [19]

Cooper

[11] 3,970,918

[45] July 20, 1976

[54] HIGH SPEED, STEP-SWITCHING AC LINE VOLTAGE REGULATOR WITH HALF-CYCLE STEP RESPONSE

[76] Inventor: Edward Cooper, 2612 Penrose St., San Diego, Calif. 92110

[22] Filed: Jan. 13, 1975

[21] Appl. No.: 540,647

[52] U.S. Cl. ..... 323/6; 307/133; 323/43.5 S

[51] Int. Cl.[2] ..... G05F 1/24

[58] Field of Search ..... 323/17, 22 SC, 43.5 S, 323/6; 307/133

[56] References Cited

UNITED STATES PATENTS

| | | | |
|---|---|---|---|
| 3,388,319 | 6/1968 | Paynter | 323/43.5 S |
| 3,619,765 | 11/1971 | Wood | 323/43.5 S |
| 3,818,321 | 6/1974 | Willner et al. | 323/43.5 S |
| 3,886,433 | 5/1975 | Watanabe | 323/43.5 S |

*Primary Examiner*—Gerald Goldberg
*Attorney, Agent, or Firm*—Brown & Martin

[57] ABSTRACT

An AC line voltage regulator having a cross-coupled memory circuit that interlocks up and down counter logic channels in a manner that successive stepping in the same direction is accomplished in half-cycle steps, while oscillatory stepping between two adjacent ranges is limited to full cycle steps to prevent any DC component in the regulated output. An alternate circuit uses a dual gating circuit in a bi-directional counter to achieve the same regulation characteristics.

6 Claims, 6 Drawing Figures

HIGH SPEED, STEP-SWITCHING AC LINE VOLTAGE REGULATOR WITH HALF-CYCLE STEP RESPONSE

BACKGROUND OF THE INVENTION

There are several types of step-regulating AC line regulators available from several manufacturers. Among these are tap-switching and multi-primary switching devices. These two types have several advantages because they combine many desirable features such as low cost, small size, no generated noise, and high efficiencies in the order of 99 percent.

The present and future demand for electrical power is increasing to such a level that the power companies can no longer satisfy the demand, and thus power shortages and brown-outs occur frequently. At the same time, electronic equipment, computers and communications systems have become so sophisticated that such equipments can only operate with well regulated AC input power. So variation in line voltages to such equipments, as result from over-load conditions, power shortages, brown-outs or just major changes in load conditions can adversely affect such equipments, which will have catastrophic results in critical applications. One solution to these problems which is being offered for those critical applications is known as Uninterruptable Power Systems. These systems have an energy storage; usually a bank of batteries that are constantly being charged from the AC input power. When power interruptions occur the storage devices then supply DC power to a converter which generates regulated AC power for the critical system. The uninterruptable power systems are not only bulky but they are very complex and expensive. Step-switching regulators can be used for such critical applications if their speed of response is made fast enough, and if the regulation steps do not cause unsummetric output waveforms. Unsummetric output waveforms are equivalent to a DC component in an AC circuit and can cause saturation in the magnetic components of the load. Of course, those magnetic components are the power transformers in the critical systems.

High performance, step-switching regulators make their ranging steps at zero voltage crossing so that no switching noise is generated. Once a range step has been made, no further correction can be made until the next zero crossing. However, if range steps are permitted to occur in successive half cycle intervals, then this generally causes unbalanced output voltages. These output voltages are substantially the same as or comparable or equivalent to the unsymmetric output waveforms. A practical solution to this problem is to limit the range stepping so that it occurs only once during a full cycle, i.e. on every second zero crossing. But this approach represents a severe limitation on the speed of response time and makes the step-switching regulator useless for all critical applications. It is therefore desirable to have a step-switching regulator that can respond to line voltage transients in successive half cycle intervals, without generating any magnetic unbalance in the output.

SUMMARY OF THE INVENTION

In an embodiment of the line voltage regulator of this invention, a known switch means is used for regulating the line voltage. This switch means may incorporate any known switching arrangement for connecting transformer devices, transformer taps, or other switch means for regulating line voltage. A sense circuit means detects the magnitude of the line voltage and provides up or down condition signals when the line voltage varies by a given magnitude up or down from a set voltage to be regulated. This set voltage may be any voltage to which the voltage regulator is set to hold the line voltage, within given plus or minus variations. A zero crossing detector means, or strobe generator, detects half cycle zero crossings of the line voltage and provides output signals at the zero crossings. A gate circuit is responsive to the up or down output signal conditions from the sense circuit, and from strobe signals from the zero crossing detector means, to provide up or down control signals to the switch means. Thus the switch means in response to the up/down signals from the gate circuit means, switches components as required to raise or lower the regulated voltage.

The gate circuit means includes gate control means for preventing oscillatory half cycle, up and down control signals to the switch means. This is accomplished by inhibiting the gate circuit means from providing up or down output signals in response to up or down signal conditions from the sense circuit means under certain conditions. These conditions are that the gate control means inhibits the gate circuit means from providing an up switch signal after a down switch signal unless the switch signal preceding the down switch signal was a down switch signal, and from providing a down switch signal after an up switch signal unless the preceding signal was an up switch signal. This is accomplished by using a cross-coupled memory circuit or gating circuit that interlocks the up and down counter logic channels in a manner that successive stepping in the same direction is accomplished in half-cycle steps, while oscillatory stepping between adjacent ranges is limited to full cycle steps to prevent any DC component in the regulated output. This function to reduce the problem of producing unsymmetric output waveforms or unbalanced output voltages in high performance, fast operating step switching.

It is therefore the object of this invention to provide a new and improved line voltage regulator.

It is another object of this invention to provide a new and improved method of regulating line voltages.

Other objects and many attendant advantages of this invention will be more apparent upon a reading of the following detailed description and examination of the drawings, wherein like references numerals designate like parts throughout and in which.

Figure 1:
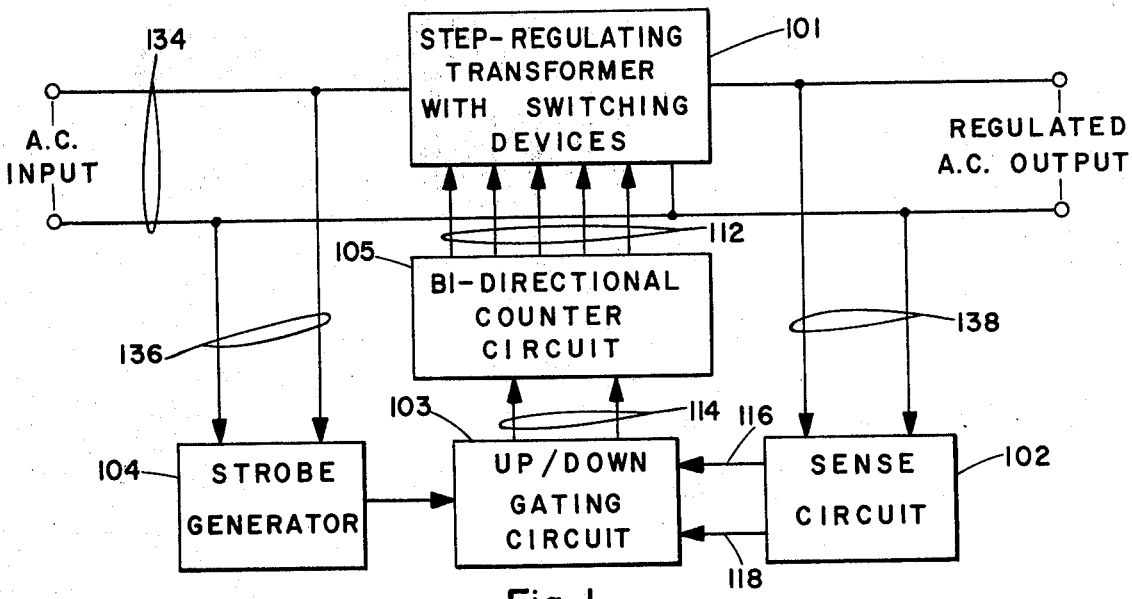
FIG. 1 is a schematic and overall block diagram of an embodiment on the line voltage regulator.

Referring now to FIG. 1, a step switching AC line voltage regulator is illustrated. The regulating element is a known step switching transformer circuit arrangement 101 with suitable switching elements for buck-/boost operation. A sense circuit 102, monitors the regulated output voltage through lines 38 and compares the output to a standard cell to determine whether the output is varying beyond a given magnitude. If the output voltage is out of the regulated limits, a corresponding up/down logic command is then generated and directed to a gating circuit 103. The up/down gating circuit 103 also simultaneously receives an input from a strobe generator 104 that is a zero crossing detector that provides output pulses when the input line voltage crosses zero. The gating circuit 103 passes the up/down command signals through lines 114 to a bi-directional counter 105 at the zero voltage crossing time, so that the counter can change its state and the switching devices controlling the step regulating transformers only at that instant. The outputs through lines 112 from the counter 105 control the switching elements in the regulated transformer circuit 101.

Figure 2:
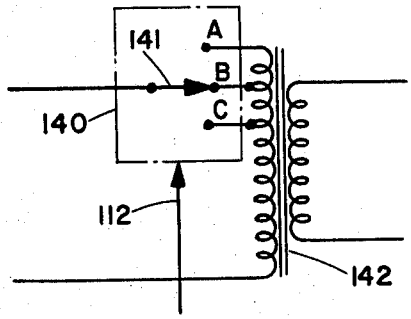
Fig. 2 PRIOR ART
FIG. 2 is a diagrammatic illustration of a particular step regulating transformer and switch device utilizing tap switching of windings in a regulating transformer to achieve AC voltage regulation.
Figure 3:
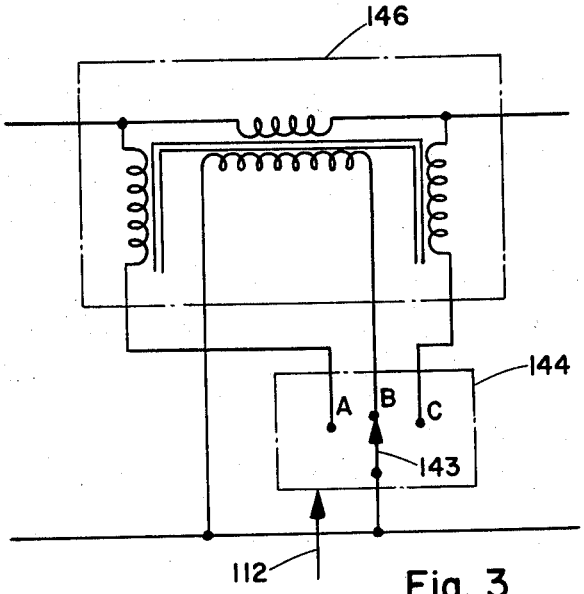
Fig. 3 PRIOR ART
FIG. 3 is a diagrammatic illustration of another known self-regulating transformer and switching arrangement that uses multiple transformer primary switching to achieve AC voltage regulation.

It may be understood that the zero crossing detector of the strobe generator 104 can be a known, standard, integrated circuit for detecting zero crossings and providing an output pulse at each half-cycle zero crossing of the input AC voltage. The strobe circuit provides an output on each positive going or negative going zero crossing. The sensing circuit 102 is a known sensing circuit that rectifies the output voltage in lines 138 and compares this rectified voltage against a reference DC voltage, and provides an up signal in line 116 when the rectified voltage is below that of the standard reference voltage, and provides a down signal through line 118 when the rectified voltage is below the reference DC voltage. The particular step regulating transformer circuit and switching devices 101 are known, examples of which are illustrated in FIG. 2 and 3. FIG. 2 shows a tap switching, step regulating transformer in which the control voltages are received through lines 112 and operate electronic switches 104 that position the tap switch member 141 to the appropriate connections A, B or C to control the windings of transformer 142 and thus the output voltage. In the exemplary embodiment in FIG. 3, the input voltage signals in lines 112 are fed to a electronic switching circuit 144, that in turn moves switch 143 to positions A, B or C that in turn closes the circuit to respective ones of the primary windings of the transformer 146, thus effecting the regulated AC output voltage. It may be understood that the number of switches in switch elements 140 and 144, and the number and complexitites of the switching structural arrangements can and are controlled through input signals through lines 112 to provide that degree of regulation desired.

Figure 4:
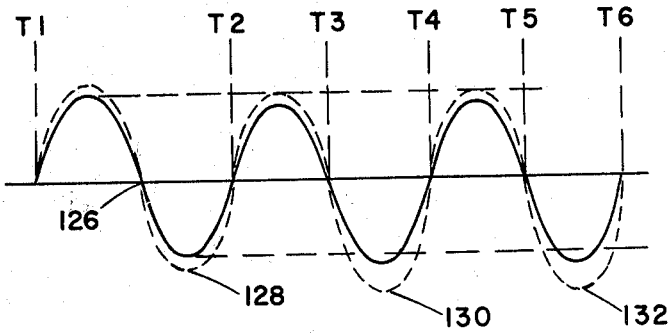
FIG. 4 is a diagrammatic illustration of the input waveform, and the unbalanced output voltages that can occur in certain types of step regulation.

FIG. 4 illustrates a waveform diagram of the input AC voltage 126 and the regulated output voltage in dotted line 128. The dotted line 128 illustrates how the unbalanced output condition can be generated if the regulator merely permits up and down range stepping in half cycle intervals. It should be recognized that the AC input line voltage often has small amounts of distortion, or small amplitude modulations which are usually caused by other loads operating on the same power circuit. It should also be recognized that the method of sensing the output voltage and determining its deviation from certain limits establishes several critical operating points for such a regulator. These critical points are the voltage levels where the sensed deviation is almost large enough to make an up or down range decision. This is where the output voltage is so close to ranging point that there is a critical operating condition because it requires only a small additional change of the input line voltage to initiate the range change. Therefore, if the output voltage is near a ranging point, a small amount of distortion or modulation in the line voltage can and does cause continuous, successively alternating up and down ranging.

From the time period T1 to T2 the operation is quite normal. However, assume that the regulator output voltage is very close to a ranging point. Also assume that at T2 some other load is connected to the same power circuit which is providing the AC input to the regulator, and that this load causes a little distortion or modulation in the input waveform. The regulator senses from T2 to T3 that the output voltage has decreased too much, and an upranging step is now forced at T3. However, the distortion or modulation in the input waveform causes a slight increase 130 of the half cycle from T3 to T4. Since the regulator had made an up-step at T3, and since the input waveform has an increased level from T3 to T4, the sense circuit determines now that the regulated output voltage has gone too high, and a down-ranging step is forced at T4. At this point the cycle starts all over, and an oscillatory condition exists at the output of the regulator. The dotted curve shows that the regulated output 128 has a gross unbalance 130 and 132 from T3 on, and this unbalance is effectively a DC component. Depending on how the switching devices are arranged in the regulating transformer circuit 101, the unbalance can cause destruction of the switches, and it can cause saturation of transformers in the load. If range steps are permitted only in even cycle intervals, the unbalanced condition cannot occur. However, the speed of response to a large line voltage transient is then severely limited, and as previously described will not provide line voltage changes fast enough for initial applications.

Figure 5:
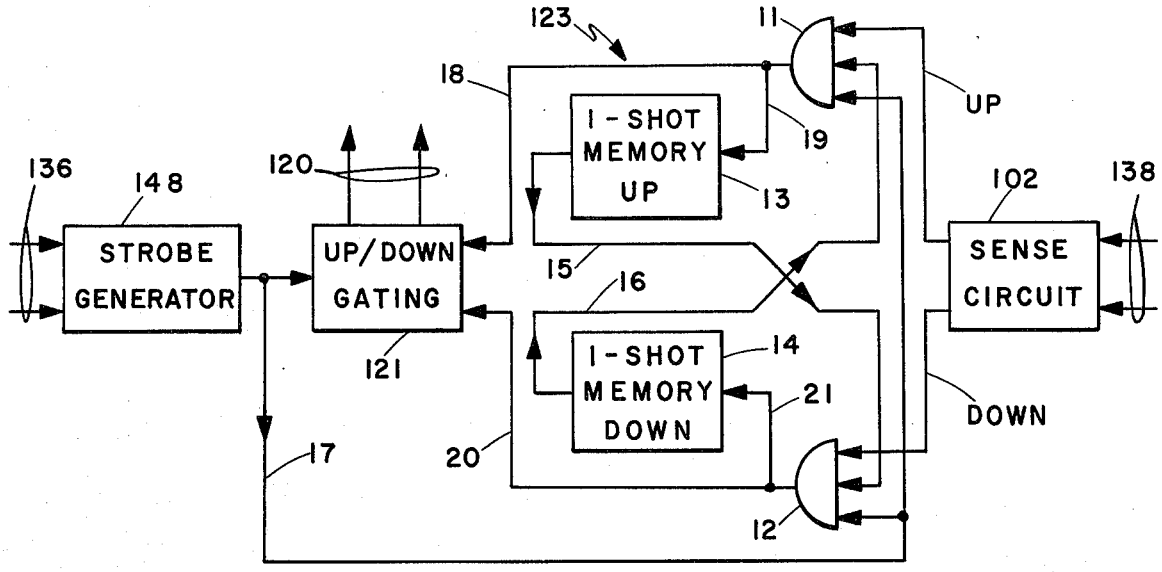
FIG. 5 is a block diagram of one embodiment of a gate control means of this invention.

One solution to obtaining fast, half cycle step response for large line input voltage steps, without permitting oscillatory conditions when the input waveform is slightly unbalanced is illustrated in FIG. 5. FIG. 5 illustrates an up/down memory circuit 123 which may be inserted between the sense circuit 102 and the up/down gating 121. Such a memory circuit 123 permits successive stepping in the same direction, in half cycle intervals. At the same time, the memory circuit 123 only permits the passage of alternating up and down commands in full cycle intervals. The circuits which are necessary to construct the memory circuit are individually available in the form of integrated circuits and require no detailed description. The elements of the memory circuit are illustrated in FIG. 5 in relationship to the functional block diagram of FIG. 1. Like numbers are used for like functions throughout the various illustrations. The memory circuit consists of two 3-input gates 11 and 12 and two one-shot multivibrators 13 and 14. The outputs of the two one shots 13 and 14 are cross-coupled via lines 15 and 16 as "disable" inputs for the 3-input gate of the opposite logic channel. The time constant of the one-shots is chosen so that it is slightly longer than the period of one half cycle. For example, if the regulator has to operate on 50 or 60 Hz power lines, a time constant of about 12ms would be used.

The memory circuit operates as follows: Assume that the sense circuit 102 has detected that an output correction is necessary, and therefore is generating an UP command. The UP command is connected as one input to gate 11. When the strobe generator 148 fires on the next following AC zero crossing, it feeds the strobe pulse not only into the up/down gating logic 121, but also via line 17 to one input of gate 11, and one input of gate 12. One-shot 14 was not previously fired so line 16 holds gates 11 in a go-state. All three inputs of gate 11 are now in a go-state, so that the UP command from the sense circuit 102 is passed through gate 11 to the up/down gating circuit 103. However, the output of gate 11 is also connected via line 19 to trigger one-shot 13. The output of one-shot 13 is connected via line 15 as a disable input to gate 12. Once the one-shot 13 has been fired it will disable gate 12 for as long as the one-shot stays fired. The time constant of the one-shot is chosen so that it is slightly longer than one half cycle of the line voltage. Consequently, gate 12 is still disabled when the next zero crossing occurs in the line voltage.

If the sense circuit 102 generates a down command at the time of the second strobe, that down command can not pass through gate 12 at that time because one-shot 13 is holding gate 12 disabled. On the other hand, if another UP command from sense circuit 102 is present at the time of the second zero crossing and output signal from strobe generator 148 through line 17 to gate 11, it will pass through gate 11. It can be seen that gates 11 and 12 operate in a similar manner, and that the one-shots 13 and 14 have the identical function of disabling the gates in the opposing logic channels. Thus, the one-shots 13 and 14 serve as temporary memory circuits to disable opposing logic channels for a sufficient period so that alternating up/down steps at successive half cycles are inhibited. However, the same memory circuits permit successive, half cycle steps in the same direction.

The memory circuit of FIG. 5 requires that the one-shots 13 and 14 have a retriggerable configuration so that the timing period is always restarted from the same starting point when successive steps occur in the same direction. The timing network thus must have very good stability so that the one-shot period remains stable for years of operation, and for drastic changes in operating temperatures. Components and integrated circuits are available that have the necessary stability characteristics. However, an alternate circuit can be used which requires no stability of components. This alternate circuit employs a dual gating technique and is illustrated in FIG. 6.

Figure 6:
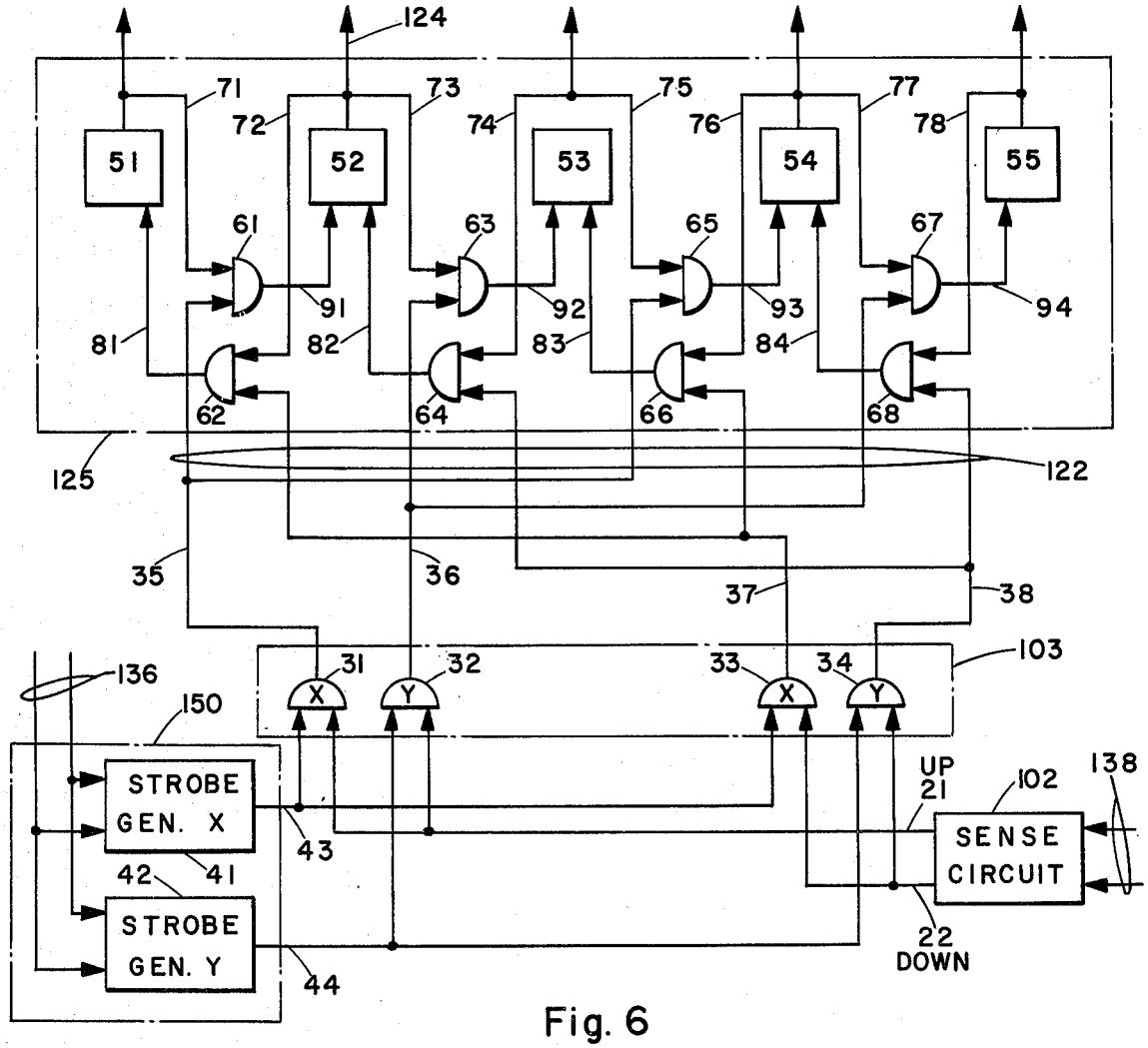
FIG. 6 is a block diagram of a modified embodiment of the gate control means.

In FIG. 6, the strobe generator 150 is modified to generate two outputs, 43 and 44. This can be accomplished by using two separate zero crossing detector circuits 41 and 42 with a rectifier diode in the input to each detector and one of the diodes being reversed relative to the other. The two outputs 43 and 44 may be represented by the logic nomenclature X and Y. These two strobes are generated in such a manner that they occur in alternating succession, one only for each zero crossing of the input line voltage. It can be assumed that the X strobe is generated by detector 41 when the line voltage crosses from the positive to the negative half cycle, and detector 42 generates the Y strobe when the line voltage crosses from the negative to the positive half cycle.

The X and Y outputs from strobe generator 150, and the UP and DOWN outputs from the sense circuits 102 are connected into a set of dual gates 103, via lines 21, 22, 43 and 44 respectively. The dual gates comprise the two-input AND-gates 31, 32, 33 and 34. The outputs of the dual gates connect into the bi-directional counter 125 via lines 35, 36, 37 and 38, comprising as a group lines 122. The bi-directional counter 125 includes an up/down steering logic which comprises the logic gates 61 through 68, with logic inputs from the outputs of the counter stages 51 through 55 via lines 71 through 78. The count steering for UP-counting is accomplished by gates 61, 63, 65 and 67 via lines 91, 92, 93 and 94. The count steering for DOWN-counting is accomplished by gates 62, 64, 66 and 68 via lines 81, 82, 83 and 84.

The actual number of counter stages is determined by the number of step controls in the regulator 101, and five stages are only assumed in this discussion to illustrate the operation of the circuit. The interconnection of the steering gates 61 through 68 between the various counter stages is conventional, with the only exception that the counter of this invention has four input lines v. the conventional two inputs. The conventional two inputs to a bi-directional counter are the UP and DOWN count pulses. However, the counter of this invention has two UP-inputs (lines 35 and 36), and two DOWN-inputs (lines 37 and 38).

It should now be understood that, when a large change in the line voltage occurs, the sense circuit 102 generates a continuous command in either the UP or DOWN direction. Assuming that the line voltage was initially very low and has just made a large step to a high level, as long as the line voltage was low, the counter 125 was in its lowest count position, and stage 51 is activated. As soon as the line voltage changes to the high level, this is sensed by the sense circuit 102 and an UP command is generated in line 21. Line 21 connects as input to the two UP-gates 31 and 32. The second input to the two UP-gates comes via lines 43 and 44 from the X and Y strobe generators 41 and 42. It was shown above that the X and Y strobe generators are activated in alternating succession, at half cycle intervals. So, the two UP-gates 31 and 32 are now also subject to being activated in alternating succession. It is assumed that the counter was initially in its lowest position, i.e. stage 51 was active. The UP-gate 61 has logic inputs from counter stage 51 via line 71, and from the up-gate 31 via line 35. Since gate 31 is activated at the X strobe time, the counter 125 will now advance by one count so that stage 52 becomes active by a signal in line 91. The next following count steering is accomplished by Up-gate 63 and line 92. Gate 63 will become active as soon as gate 32 passes the Y strobe via line 36, and the counter will advance from stage 52 to 53 at that time. The next following UP-steering is handled by gate 65 and line 93. Gate 65 has one input connected to gate 31 via line 35. Therefore, it will be activated from the X strobe, and the count advances from stage 53 to 54 at the X strobe time. It should now be obvious how the count advance is accomplished in successive, half cycle steps with the dual gating technique. The outputs of lines 124 control respective switches in the step regulator 101 as previously described.

Similarily, the dual gating technique is employed to achieve successive, half cycle down counting via gates 33 and 34. These two gates are the dual DOWN gates, and are activated alternatingly by the X and Y strobes via lines 43 and 44.

The foregoing illustrates that the counter 125 makes continuous steps in the same direction, either UP or DOWN in successive, half cycle intervals. However, the outputs of the dual gates are connected into the steering logic (gates 61 through 68) in such a manner, and in such phase relationship that any oscillatory count condition back and forth between two adjacent counter stages can only occur in intervals of full cycles. This phase relationship is established by driving each pair of steering gates between two adjacent counter stages from the same strobe. For example, gates 61 and 62 are a steering pair between two adjacent counter stages. Gate 61 steers the UP-count from 51 to 52, and gate 62 steers the DOWN-count from 52 to 51. Both gates, 61 and 62 can only be activated by strobe X via gates 31 and 33. The steering pair 63 and 64 can only be activated by strobe Y via gates 32 and 34. The steering pair 65 and 66 is operation by the X strobe, and the pair of gates 67 and 68 are operated by the Y strobe.

It should be obvious that, if an associated steering pair between two counter stages is only operated by one of the two strobes, for example the X strobe, an oscillatory change back and forth between those two counter stages can only occur in intervals of full cycles because the X strobe occurs only in full cycle intervals. Similarily, the Y strobe occurs also only in full cycle intervals.

So the dual gating technique can be used in conjunction with proper phasing in the steering logic of a bi-directional counter to achieve high speed, continuous counting in half-cycle steps in the same direction, and that the same circuit permits oscillatory count steps between two adjacent counter stages only in full cycle intervals. When this counter system is used in a step-switching AC voltage regulator, it permits the regulator to respond to large voltage transients in half-cycle steps, and it limits oscillatory steps between two adjacent ranges so that they can occur only in full cycle intervals. Thus, the generation of unbalanced output waveforms 130 and 132 and DC components in the output is eliminated, while the speed of response time for large voltage transients is greatly improved. It was shown earlier that the same speed of operation can be achieved with two cross-coupled memory circuits in the up/down logic.

Having described my invention, I now claim:

1. An AC line voltage regulator comprising, switchable means for regulating the line voltage, sense circuit means for detecting the magnitude of the line voltage and providing an up or down condition signal when the line voltage varies by a given magnitude up or down from a set voltage to be regulated, zero crossing detector means responsive to the line voltage for detecting and providing output signals at half cycle zero crossings of the line voltage, gate circuit means responsive to the sense circuit means up or down condition signal and an output signal from said zero crossing detector at each half cycle for providing a corresponding up or down switch signal to said switch means at each half cycle that the line voltage has varied from the given magnitude, and said gate circuit means including gate control means for inhibiting the providing of an up switch signal after a down switch signal unless the switch signal preceding the down switch signal was a down switch signal and from providing a down switch signal after an up switch signal unless the preceding signal was an up switch signal.

2. An AC line voltage regulator as claimed in claim 1 including, an up gate circuit responsive to an up condition signal and a zero detector output signal for providing an up switch signal to said switch means, a down gate circuit responsive to a down condition signal and a zero detector output signal for providing a down switch signal to said switch means, a condition means for providing an inhibiting signal to said down gate circuit in response to an up switch signal in a first condition and an inhibiting signal to said up gate circuit in response to a down switch signal in a second condition, and means for holding said condition means in said first or second condition for a period at least greater than one half cycle of the line voltage.

3. An AC line voltage regulator as claimed in claim 2 wherein, said up gate circuit having an up control gate, said down gate circuit having a down control gate, said zero crossing detector means providing output signals each half cycle to each of said up control gates and down control gates, the output of said up control gate being fed as an input inhibiting input to said down control gate and the output of the down control gate being fed as an inhibiting input to said up control gate, and a timing means for holding said outputs of said up gate and down gate for a period greater than one half cycle but less than one full cycle.

4. An AC line voltage regulator as claimed in claim 2 wherein, said zero crossing detector means providing a first output signal at one half cycle zero crossing and a second output signal at the next half cycle zero crossing of the line voltage, a bi-directional counter circuit having individual counting components for providing up and down switch signals to said switch means, said up gate circuit including a plurality of up gates providing outputs for causing said counting components to count up in response to up switch signals, said down gate circuit including a plurality of down gates providing outputs for causing said counting components to count down in response to down switch signals, said first output signal being fed to alternative ones of said up gates and down gates, said second output signal being fed to the alternative ones of said up gates and down gates, and said counter circuit being responsive to said outputs of said up gates and down gates to provide successive up-count stepping in response to continuous first output signals and second output signals in conjunction with an up condition signal from said sense circuit means, and providing successive down-count stepping in response to continuous first output signals and second output signals in conjunction with a down condition signal from said sense circuit means and limiting to two half cycles or a full cycle any change in successive up stepping or successive down stepping of the counter with a change in up or down condition signals from the sense circuit means.

5. The method of providing AC line voltage regulation comprising the steps of, detecting the magnitude of the line voltage and providing up or down signals when the line voltage varies by given magnitude up or down from a desired voltage, detecting zero crossing of the line voltage and providing an output signal at each half cycle zero crossing, detecting an up or down voltage condition signal output from the sensing circuit at the simultaneous occurrence of a half cycle crossing signal from the zero crossing detector and providing a corresponding up or down switch signal, providing successive up signal stepping or down signal stepping on half cycles, and only providing oscillatory stepping between up and down signals on full cycles, and switching components for line voltage regulation in response to the up or down switch signals.

6. The method as claimed in claim 5, including the characterizing steps of, providing an up switch signal on a half cycle only after a preceding up switch half cycle signal or two preceding down switch half cycle signals and, providing a down switch signal on a half cycle only after a preceding down switch half cycle signal or two preceding up switch half cycle signals.

* * * * *